United States Patent [19]

Avery

[11] Patent Number: 4,580,990

[45] Date of Patent: Apr. 8, 1986

[54] PNEUMATIC AERIAL AMUSEMENT DEVICE

[75] Inventor: John R. Avery, Athens, Tenn.

[73] Assignee: J. J. Avery, Inc., Athens, Tenn.

[21] Appl. No.: 631,340

[22] Filed: Jul. 16, 1984

[51] Int. Cl.[4] ..... A63H 27/00

[52] U.S. Cl. ..... 446/46; 446/220

[58] Field of Search ..... 446/220, 221, 222, 225, 446/46, 47

[56] References Cited

U.S. PATENT DOCUMENTS

| | | | |
|---|---|---|---|
| 2,864,201 | 12/1958 | Leise | 446/46 |
| 3,758,985 | 9/1973 | Heisler | 446/46 |
| 4,135,325 | 1/1979 | Lehman | 446/46 |
| 4,307,537 | 12/1981 | Bergmann | 446/222 |
| 4,318,244 | 3/1982 | Magid et al. | 446/221 |
| 4,335,536 | 6/1982 | Magid et al. | 446/46 |

*Primary Examiner*—Robert A. Hafer
*Assistant Examiner*—Daniel Nolan
*Attorney, Agent, or Firm*—Fields, Lewis, Pittenger & Rost

[57] ABSTRACT

There is provided a pneumatic amusement device formed of heat sealable plastic and characterized by an inflatable, ball-like central portion, and a flexible equatorial girdle or rim. An inlet is provided into the cavity and means for plugging the inlet. The device is formed of discs of heat sealable plastic material.

3 Claims, 7 Drawing Figures

PNEUMATIC AERIAL AMUSEMENT DEVICE

DESCRIPTION

1. Technical Field

The present invention relates to an aerial amusement device of the same general class as the well-known "Frisbee." Like the well-known "Frisbee," the present device is tossed between participants with a back-handed motion and also, like the "Frisbee" and because of its structure, will sail through the air in more or less stable flight between participants.

2. Background Art

The prior art includes U.S. Pat. No. 290,788 to Moyer and U.S. Pat. No. 2,835,073 to Dame, each of which shows a rigid disc surrounding an essentially spherical rigid center. U.S. Pat. No. 303,885 to Ridge and U.S. Pat. No. 3,758,985 to Heisler, show a rigid disc having an inflatable center portion. The Heisler device has the center portion inflated only while the device is traveling through the air due to air entering the center portion through air scoops provided in the disc. U.S. Pat. No. 1,858,460 to Ranseen and U.S. Pat. No. 3,109,256 to Dean each show other inflatable flying toys of the same general class. U.S. Pat. No. 1,226,482 to Kamrass, U.S. Pat. No. 2,759,296 to Freck, U.S. Pat. No. 3,331,087 to Barlow, British Pat. No. 978,348 and German Pat. No. 278,524 show different forms of inflatable cushions.

DISCLOSURE OF THE INVENTION

The present structure is simplified both as to construction and fabrication in being formed of a heat sealable material, such as polyvinyl chloride or polyethylene or polypropylene or other such thermoplastic material. In general, discs formed from sheet plastic are superimposed one upon the other in a concentric relationship, one of the discs being provided with a centrally located valve, and heat sealed along an annulus intermediate the center of the discs and the outer periphery thereof.

BRIEF STATEMENT OF THE INVENTION

More specifically, the present invention is a pneumatic aerial amusement device formed of heat sealable plastic and consisting essentially of first and second discs of heat sealable plastic in concentric relationship, a concentric annular seal between the first and second discs having maximum diameter smaller than the diameter of at least one of the discs, the diameter of the other of the discs being at least the maximum of diameter of the concentric seal, the first and second discs defining inwardly of the seal an inflatable cavity, and defining externally of the cavity a flexible equatorial girdle of substantial width. An inlet is provided to the cavity, preferably through the center of one of the discs, together with means for plugging the inlet.

BRIEF DESCRIPTION OF THE DRAWINGS

The present invention may be better understood by having reference to the annexed drawings wherein.

DETAILED DESCRIPTION OF THE DRAWINGS

Figure 1:
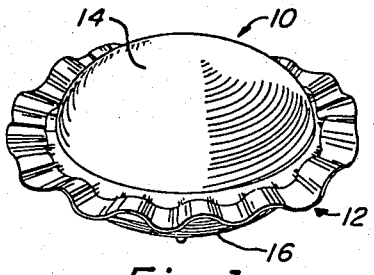
FIG. 1 is a perspective view of one embodiment of the present invention showing an inflated central portion and a flexible equatorial girdle or rim having a generally sinuous configuration.
Figure 4:
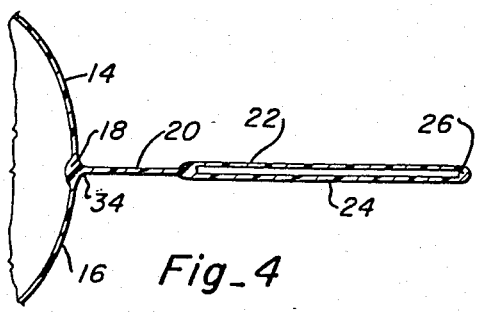
FIG. 4 is a fragmentary cross-sectional view on an enlarged scale of the device shown in FIG. 3 as it appears in the plane indicated by the line 4—4.
Figure 2:
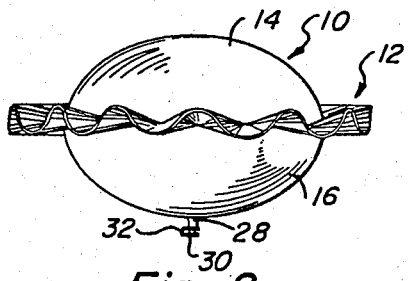
FIG. 2 is a side view of the device shown in FIG. 1, showing the upper and lower cavity forming members and the equatorial girdle.
Figure 3:
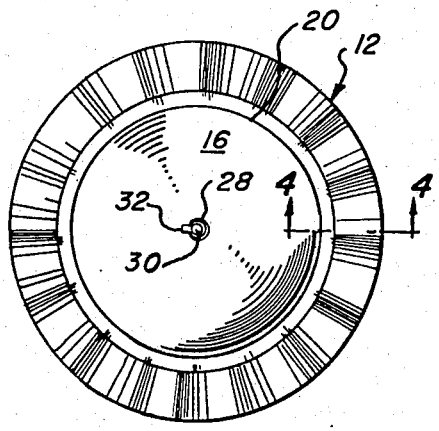
FIG. 3 is a bottom view of the device shown in FIG. 2 of the device showing the central location of the plugged air inlet to the inflatable cavity.

Referring now more particularly to FIGS. 1–4, there is here shown an aerial amusement device shown of heated sealable plastic material such as polyvinylchloride. The device comprises an inflatable central portion 10 and an equatorial or encircling girdle or rim portion 12, preferably having a width greater than one-third the radius of said central portion, as best illustrated in FIG. 3. The inflatable portion 10 consists of an upper half 14 and a lower half 16, joined by means of heat sealing along a circumferential bead 18 and a radially outwardly extending annular seal portion 20. As is best shown in FIG. 4, the device depicted in FIG. 1 is formed from circular discs. A first circular disc 22 is superimposed upon a second circular disc 24 of preferably like diameter. These discs are sealed along their outer marginal edge as at the bead 26, and along the annular heat seal portion 20. The only difference between discs 22 and 24 is that in the preferred case, the lower disc 22 is provided with a centrally located inlet 28 having a plug 30 attached thereto by means of a strap 32 for inflating and deflating the central portion.

FIG. 3 shows the structure in deflated condition from the bottom at which time the equatorial girdle portion 12 lies in substantially the same plane as the balance of the inflated structure. On inflation, the tendency of the inner margin 34 of the heat sealed portion 20 (FIG. 4) is to contract thereby causing the balance of the structure to assume a sinusoidal configuration as shown in FIGS. 1 and 2. This adds a decorative feature to the structure without in any way interfering with its ability to remain airborne while rotating around its vertical axis as a result of its mode of launching.

As indicated, the device is inflated through the inlet 28 and plugged with the plug 30 which is coveniently strapped directly to the inlet by means of the flexible strap 32.

Figure 5:
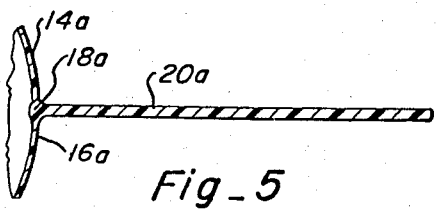
FIG. 5 is a fragmentary cross-sectional view along line 5—5 of FIG. 6 of another embodiment wherein the region of heat seal has been carried from the inflatable body to the outer periphery of the flexible equatorial girdle or rim.
Figure 6:
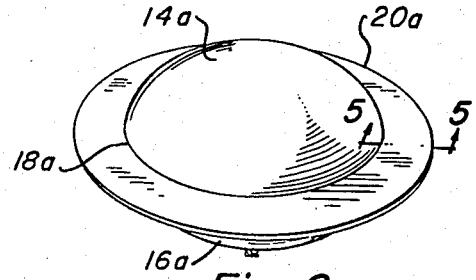
FIG. 6 is a perspective illustration of another embodiment wherein the equatorial rim is generally planar instead of sinuous as shown in FIGS. 1 and 2.
Figure 7:
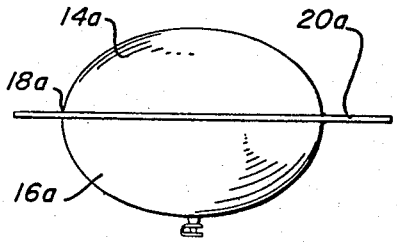
FIG. 7 is a side view of the device shown in FIG. 6.

FIGS. 5, 6 and 7 show another embodiment of the present invention wherein the heat seal annulus **20*a*, instead of being a relatively narrow band as shown in FIG. 4, is a wide band extending from circumferential bead 18*a*, joining upper half 14*a* with lower half 16*a* of the inflatable cavity, to the outer marginal edge of the disc. In this embodiment, the equatorial girdle 20*a*** or rim will tend to remain generally planar instead of assuming the sinusoidal configuration of FIGS. 1 and 2.

The practice of heat sealing heat sealable plastic members together is well known and need not be discussed in detail. In the formation of a structure such as shown in FIGS. 1–4, mating annular rims are provided and equipped with heaters to elevate the temperature to a point sufficient to effect a heat seal. The marginal seal is again formed by heating the marginal edges sufficiently to fuse the two discs together to form the bead 26. The installation of the conventional inlet and plug means is again effected by heat sealing through a suitable hole provided in the center of the top or bottom disc as may be desired. In the preferred embodiment shown in FIG. 2, the inlet is in the bottom disc.

The material of which the discs are formed is as indicated above, a thermoplastic material generally relatively highly plasticized in order to make it flexible and pliable. A common material of fabrication is polyvinylchloride containing up to 50 percent by weight of a common plasticizer such as dioctyl phthalate. These plastic materials may be pigment filled with any suitable pigmentary material such as titanium dioxide, the pigment, plasticizer and resin being compounded in a known manner to yield a white, opaque flexible plastic film. From such flexible plastic films the discs of which the present structure is fabricated are cut as by die cutting. Although it is most preferable that the upper and lower discs be of the same diameter, it is not essential. The diameter of the lower disc may be less than the diameter of the upper disc or greater as may be desired for decorative effect. So long as a circumferential seal may be effected to define the equatorial girdle or rim, and isolate it from the inflatable central portion, the relative diameters of the discs are inconsequential.

In use, the device is inflated in any known manner and plugged. A participant will then fling the inflated device toward another participant with a backhanded spinning motion whereupon the device will become airborne. Because of its configuration and spin, a certain amount of lift will be developed, causing it to sail in the direction of the other participant. The devices are manufactured and stored in a deflated condition thereby facilitating packing as well as storage. The devices are inexpensive. The invention has been described in detail with particular reference to preferred embodiments thereof, but it will be understood that variations and modifications can be effected within the spirit and scope of the invention.

I claim:

1. A pneumatic aerial amusement device formed of heat sealable plastic comprising:

a first disc of heat sealable plastic;

a second concentrically disposed heat sealable plastic disc of like diameter, said first and second discs being heat sealed along their common circumference;

a concentric annular seal between said first and second discs having a diameter smaller than the diameter of said discs, said first and second discs defining inwardly of said seal an inflatable cavity, and defining between said annular seal and said circumferential seal a flexible equatorial girdle or rim having an airspace therein, the combined width of said annular seal and said equatorial rim being sufficient to allow for gripping with the thumb and fingers;

an inlet to said cavity; and means for plugging said inlet.

2. A pneumatic aerial amusement device as claimed in claim 1, wherein:

said equatorial girdle has a generally sinuous configuration when the inflatable cavity is inflated.

3. A pneumatic aerial amusement device as claimed in claim 2, wherein:

the combined width of said equatorial rim and said annular seal is at least one-third of the radius of said inflatable cavity.

* * * * *